United States Patent [19]

Balhorn

[11] 4,260,352

[45] Apr. 7, 1981

[54] APPARATUS AND METHODS FOR DISCHARGING FLUENT MATERIAL TO BLOCK MAKING MACHINERY

[75] Inventor: Milo G. Balhorn, Waterloo, Iowa

[73] Assignee: Besser Company, Alpena, Mich.

[21] Appl. No.: 954,486

[22] Filed: Oct. 23, 1978

Related U.S. Application Data

[62] Division of Ser. No. 855,941, Nov. 30, 1977, abandoned.

[51] Int. Cl.[3] ..... B28B 1/08

[52] U.S. Cl. ..... 425/211

[58] Field of Search ..... 425/211

[56] References Cited

U.S. PATENT DOCUMENTS 3,961,874 6/1976 Balhorn ..... 425/211

*Primary Examiner*—Thomas P. Pavelko

*Attorney, Agent, or Firm*—Learman & McCulloch

[57] ABSTRACT

Fluent material such as mixed concrete to be molded into blocks is contained with a supply hopper for discharge of a predetermined quantity of such material to a mold. The hopper has a discharge opening at one side thereof, rather than at its bottom, so that material discharged from the hopper exits along a substantially horizontal path for reception in a mold supported adjacent the discharge opening. A partition is movable through material in the hopper to divide the contents thereof into upper and lower portions, the upper portion of which is supported on the partition and the lower portion of which is pushed through the hopper's discharge opening by a pusher blade carried by the partition. The leading end portion of the partition moves beyond the hopper's discharge opening and supports a quantity of the fluent material so that, upon return movement of the partition, the material on the lip is pushed off the latter adjacent the discharge opening in readiness to be discharged to the mold upon the next discharge movement of the pusher. The movable parts of the apparatus are housed within a sound absorbing enclosure having an opening through which molded blocks may pass, such opening being opened and closed in timed relation to the molding and discharge of such block.

2 Claims, 6 Drawing Figures

APPARATUS AND METHODS FOR DISCHARGING FLUENT MATERIAL TO BLOCK MAKING MACHINERY

This is a division of application Ser. No. 855,941, filed in the U.S. Patent Office on Nov. 30, 1977 now abandoned.

This invention relates to the molding of articles from fluent material and more particularly to the molding of concrete blocks. The prior art contains many examples of concrete block molding machinery. In most such machinery, mixed concrete is delivered to a supply hopper from which successive, substantially uniform charges are withdrawn and delivered to a mold open at its top and bottom. A pallet is held against the open bottom of the mold by a vertically movable pallet support and a stripper head is positioned above the mold a distance sufficient to enable a charging mechanism to move into position above the mold and discharge concrete into the latter. The charging mechanism then is withdrawn from between the mold and the stripper head, following which the latter is lowered into the mold and the mold vibrated to compact the concrete. Thereafter, the pallet support and stripper head are lowered relatively to the mold to strip the mold blocks from the mold. The molded blocks are supported on the pallet and are conveyed away from the molding machinery, and the process is then repeated for the molding of additional blocks.

In recent years considerable emphasis has been placed upon reducing the noise associated with block molding machinery, thereby prompting reevaluation of all the movable parts of such machinery and the redesign of many of such parts in an effort to minimize the noise generated by their movement. In addition, many of the component parts of such machinery have been redesigned and rearranged so as not only to minimize the generation of noise, but also to provide more efficient and less expensive constructions.

The apparatus disclosed herein incorporates many of the advantageous characteristics resulting from the aforementioned reevaluation. Briefly stated, such characteristics include the location of all operating parts of the machinery within a sound absorbing enclosure having an opening therein through which molded blocks may pass, but including a closure for such opening that is movable into a closed position during molding operations so as to form a sound barrier at such opening during block molding operations. The apparatus also includes an improved mold charging mechanism wherein material introduced to a supply hopper is discharged through one side thereof, rather than through its bottom, by means of an oscillatable charging mechanism which includes a partition movable through material contained in the hopper so as to divide the material into upper and lower portions, the lower portion containing a measured quantity of such material. The measured quantity of material is discharged through the side of the hopper at the same time that the partition moves through the material in the hopper for the reception of the mold. Preferably, the material charged to the mold is somewhat greater than that required to fill the mold, thereby assuring an ample supply of material in the mold. However, the feeding mechanism also includes means for removing any excess material from the mold and storing such material temporarily in position to be introduced to the mold during the next cycle of operation.

Apparatus and methods according to the invention are explained in the following description and are disclosed in the accompanying drawings, in which.

Figure 1:
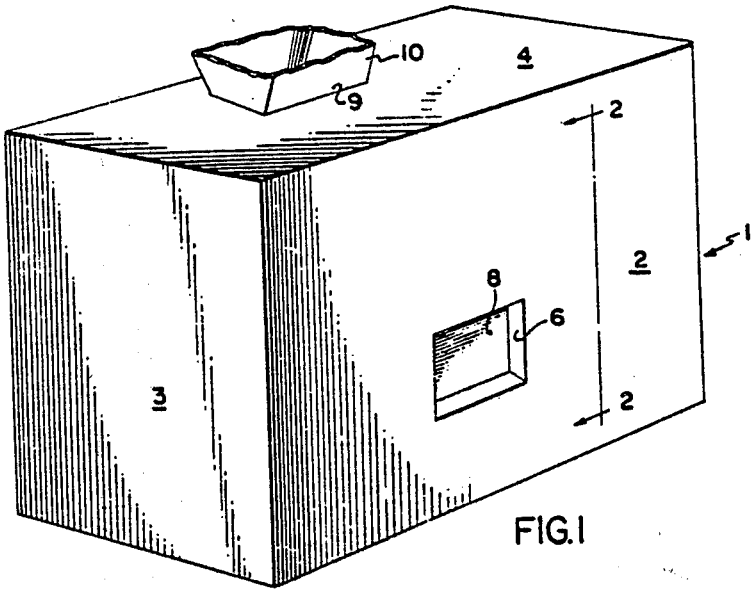
FIG. 1 is a fragmentary, isometric view of an enclosure within which the apparatus is housed.
Figure 2:
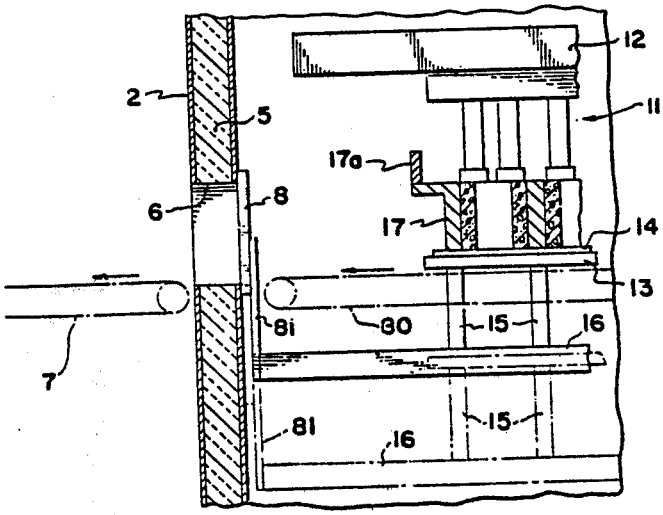
FIG. 2 is a sectional view taken along the line 2—2 of FIG. 1.
Figure 3:
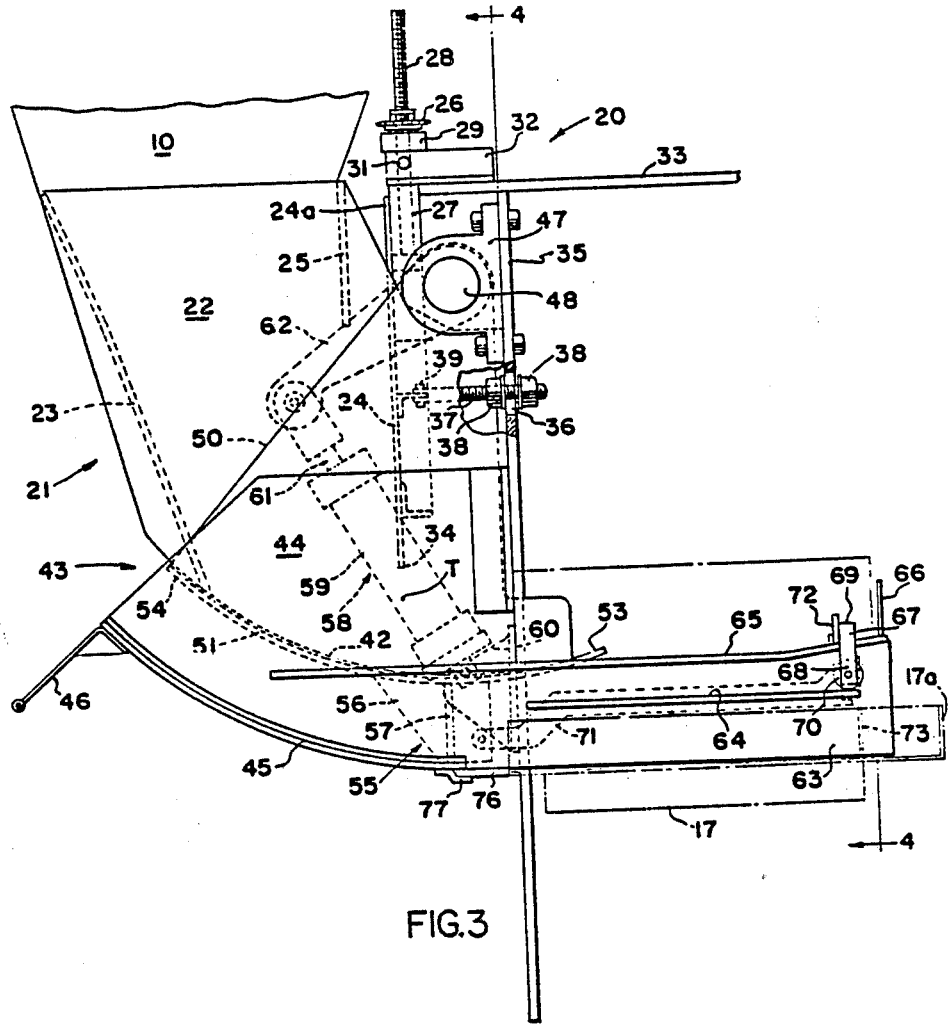
FIG. 3 is a side elevational view of the charging mechanism.
Figure 4:
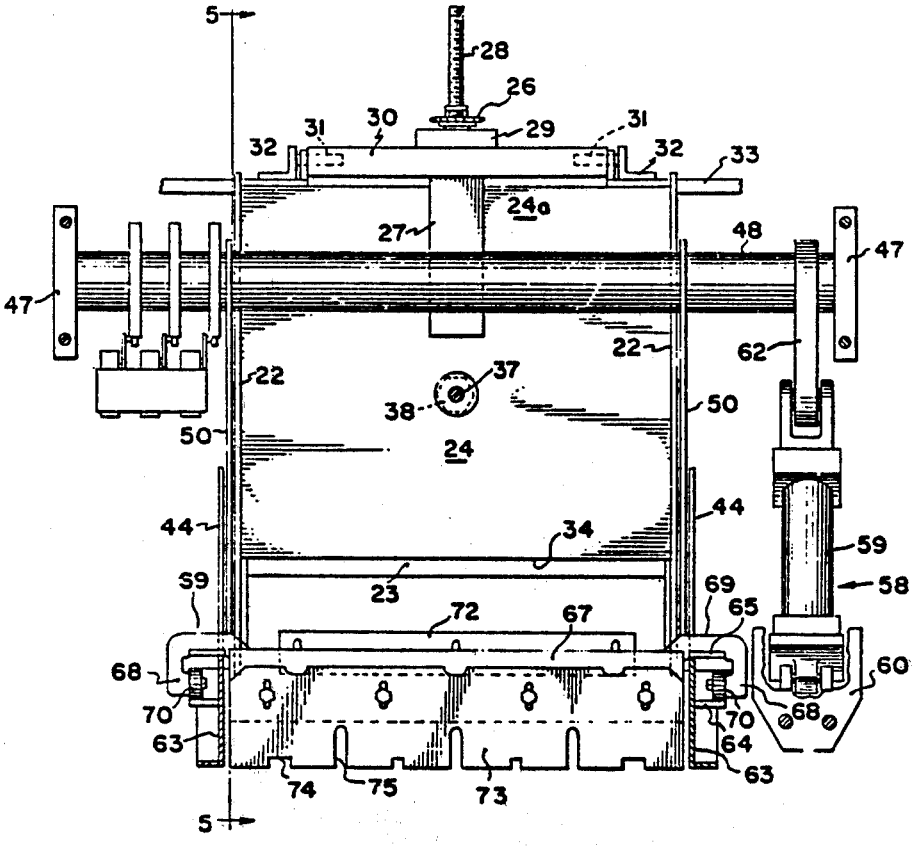
FIG. 4 is a sectional view taken on the line 4—4 of FIG. 3.

Apparatus constructed in accordance with the invention is adapted to be positioned within an enclosure 1 having a front wall 2, end walls 3 and a top wall 4, all of which have sound absorbing material 5 of known construction supported on their inner surfaces. The front wall 2 has an opening 6 therein through which molded blocks may pass, as will be explained in more detail hereinafter, for reception upon a conventional conveyor 7 for transport away from the enclosure. Associated with the opening 6 is a door or closure 8 which is adapted to move from a position in which it closes the opening 6, as shown in FIGS. 1 and 2, to a position in which the opening is uncovered.

The top wall 4 of the enclosure includes an opening 9 in which is fitted a delivery chute 10 that is positioned at its upper end in a location to receive fluent material such as concrete from a mixer (not shown).

Mounted within the frame is a stripper head 11 carried by a vertically movable stripper frame 12. Beneath the stripper head 11 is a pallet support 13 on which a removable pallet 14 is supported, the pallet support 13 being fixed to upstanding support members 15 carried by a vertically movable lifter frame 16. Between the stripper head 11 and the pallet support 13 is mounted an open top and open bottom mold 17 in which fluent material may be molded into one or more blocks. The mold has an upstanding peripheral wall **17*a*** around three of its sides, as usual.

The stripper head 11, the stripper frame 12, the pallet support 13, the pallet 14, the support members 15, the lifter frame 16, and the mold 17 form no part of the invention per se, aside from the manner in which they cooperate with apparatus yet to be described, and may be of any suitable construction such as that disclosed in U.S. Pat. No. 2,985,935.

Mold charging apparatus constructed according to the invention is designated generally by the reference character 20 and comprises a supply hopper or chamber 21 having spaced, parallel end walls 22, a rear wall 23, a front wall 24 and an open top in communication with the chute 10. Also spanning the end walls 22 and secured to the latter adjacent the front wall 24 is a brace 25. The rear wall 23 spans the end walls 22 and is secured thereto in any suitable manner. The front wall 24 spans the end walls 22, but is not fixed to the latter. Instead, the wall 24 is secured at its upper end **24*a* to a threaded sleeve 27. Threadedly accommodated in the sleeve 27 is a correspondingly threaded adjusting screw 28 that extends through a block 29 which is carried by a support 30 fitted at its opposite ends with spindles 31 that are rotatably accommodated in supports 32** mounted on a horizontal frame member 33 forming part of the main frame. Rotation of the screw 28, by means of a sprocket wheel 26 or the like, in opposite directions effects raising and lowering of the front wall 24 so as to position its lower edge 34 at a predetermined level for a purpose presently to be explained.

Extending below the top frame member 33 is an upright frame member 35, also forming part of the main frame, and which is cut away in the area of the mechanism 20. The frame member 35 is provided with a vertical slot 36 through which extends an adjusting screw 37 which carries, on opposite sides of the member 35, lock nuts 38. The inner end of the screw 37 is pivoted as at 39 to the front wall 24. The arrangement is such that the front wall 24 can be swung in either of two opposite directions about the axis of the pins 31, and retained in a selected position of adjustment, for a purpose presently to be explained.

The hopper 21 has no bottom as such. Instead, the side walls 22 terminate at their lower ends in arcuate edges 42 which extend from the lower edge of the rear wall 23 to the rear surface of the frame member 35. Fixed on the rear surface of the frame member 35, however, is a U-shaped member 43 having a pair of parallel side walls 44 located outboard of the hopper side walls 22 and being spanned at their lower edges by an arcuate base 45 that is concentric with and spaced from the arcuate edges 4 of the hopper walls 22. The base 45 underlies the hopper 21. A spillage deflector 46 is fixed at the rear end of the member 43.

The arrangement of the hopper front wall 24 and the base 45 is such that a space or opening exists between the base and the lower edge 34 of the wall 24. The opening is generally horizontal and may be referred to as the hopper discharge throat T.

Mounted on the rear surface of the upright frame member 35 is a pair of spaced apart journal blocks 47 in which is journaled a rock shaft 48. Keyed or otherwise fixed to the shaft 48 is a substantially U-shaped charging member 49 having a pair of parallel side walls 50 through the upper ends of which the shaft 48 extends, the walls 50 being interposed between the adjacent end walls 22 of the hopper 21 and the sides 44 of the member 43. Spanning the side walls 50 at their lower ends is an arcuate plate or partition 51 that is concentric with and spaced from the base 45. The partition 51 fits closely, but slidably, adjacent the lower edges 42 of the hopper end walls 22 so as to be movable relative to the latter without interference.

The arcuate length of the partition 51 is somewhat greater than the arcuate length of the curved edges 42 of the hopper side walls 22. The partition thus has a forward lip portion 53 and a rearward lip portion 54, the purposes of which will be explained hereinafter.

Depending from the partition 51 is a pusher structure 55 comprising brackets 56 between which is slidably retained a scraper blade 57 that constantly engages the base 45. The pusher blade is mounted on the partition 51 rearwardly of the lip portion 53 for a purpose to be explained.

Means for moving the charging member 49 along a reciprocatory oscillating path comprising a double acting ram 58 having a cylinder 59 pivoted on a bracket 60 carried by the frame 35 and having a piston rod 61 pivoted to a crank 62 that is keyed or otherwise fixed to the rock shaft 48. Extension of the ram 58 effects movement of the charging member 49 rearwardly about the axis of the shaft 48, and contraction of the ram 58 effects movement of the charging member in the opposite direction.

Fitted to the side walls 44 of the member 43 is a pair of forwardly projecting rails 63 each of which has a laterally extending track 64 and an uppermost track 65. At their forward ends the rails 63 are spanned by an upstanding splash plate 66. Slidably accommodated between the rails 63 is a mounting plate 67 having ears 68 at its opposite ends. Each ear embraces the upper edges of the associated rail and has an upper portion 69 which overlies the upper track 65 and is welded or otherwise fixed to the bar 67. At its lower end each ear 68 is provided with a roller 70 which rides upon the track 64. Each ear 68 is pivoted to one end of an operating bar 71, the opposite end of which is pivoted at the forward end of the bracket 56 at the corresponding side of the charging member 49, thereby enabling the mounting plate 67 to move longitudinally of the rails 63 in response to the oscillation of the charging member.

The rails 63 extend forwardly of the frame member 35 a distance sufficient to overlie all cavities in the mold 17 and to underlie the stripper head 11. The mounting bar 67 thus may be provided with a flexible scraper 72 which is adapted to clean the lower surface of the stripper head 11 and with a scraper or rake 73 that is adapted to move across the upper surface of the mold 17. If necessary, the scraper plate 73 may be provided with grooves and notches 74 and 75, respectively, to accommodate dividers (not shown) forming part of the mold 17.

It is conventional to vibrate the mold of concrete block making machinery. Thus, there is some clearance between the mold 17 and the base 45. To minimize the spillage of concrete through such clearance, the forward end of the member 43 is provided with a flexible, resilient strip 76 having a free end which bears against the mold 17 and an anchored end that is trapped between the base 45 and a retainer bar 77 fixed to the base.

Figure 6:
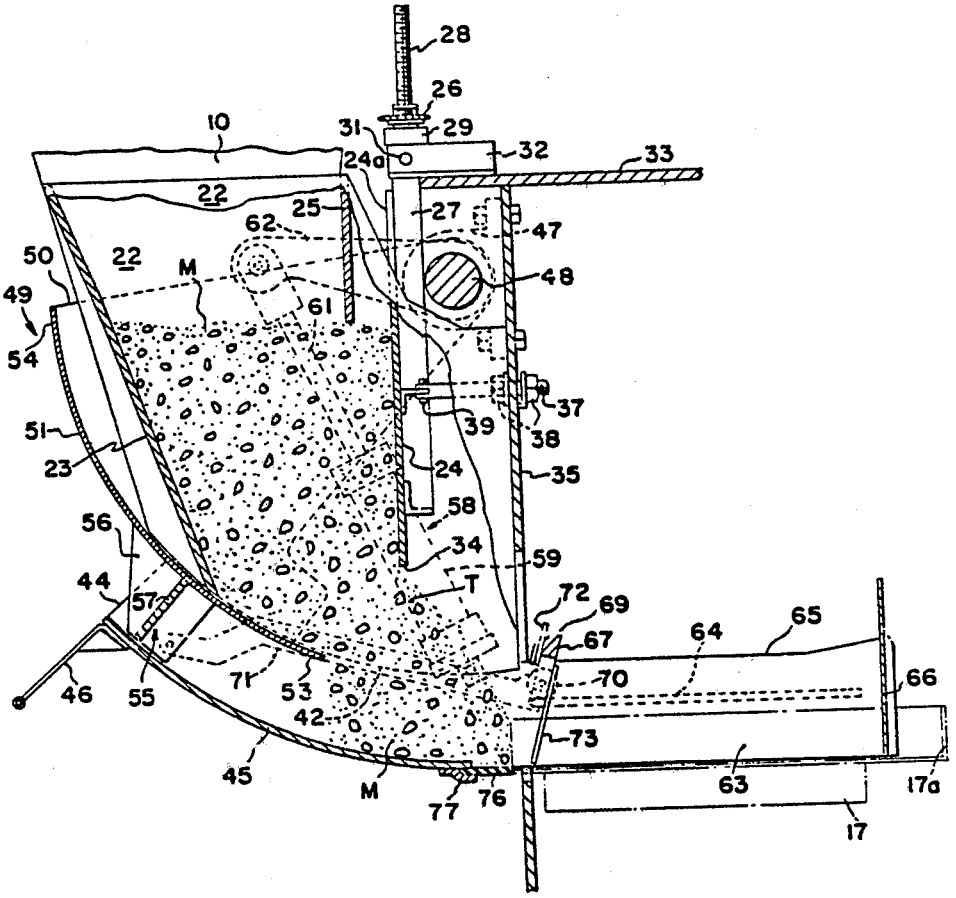
FIG. 6 is a view similar to FIG. 5, but illustrating the parts in adjusted positions.

When the apparatus is conditioned for operation, the pallet lifter frame 16 will be elevated to the full line position shown in FIG. 2 to a position in which a pallet 14 bears against and closes the bottom of the mold 17. The stripper frame 12 will be in a position elevated from that shown in FIG. 2 so as to maintain the stripper head 11 at a level above that of the mold. The ram 58 will be in its extended position, as shown in FIG. 6, thereby locating the charging member 49 in its rearward or initial position. In this position of the charging member, the forward lip 53 of the partition 51 is located somewhat forwardly of the hopper rear wall 23. Fluent concrete M will be introduced to the hopper 21 via the chute 10 and such material will rest on the base 45, as is indicated in FIG. 6.

Figure 5:
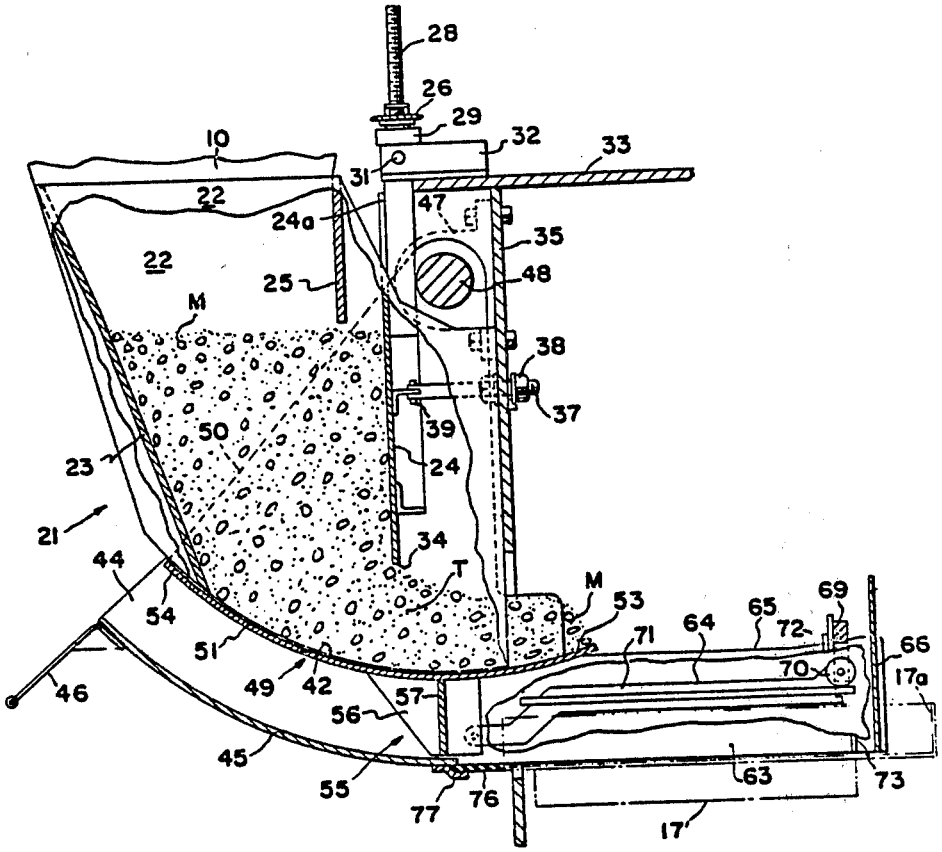
FIG. 5 is a sectional view taken on the line 5—5 of FIG. 4.

When the ram 58 is retracted, the charging member 49 will be rocked counterclockwise from the initial position shown in FIG. 6 toward a second position shown in FIG. 5. During such movement, the partition 51 will cut through the material in the hopper 21 and divide it into upper and lower portions. The upper portion will be supported on the partition and the lower portion will be supported on the base 45.

As the partition 51 moves, the pusher structure 55 also will move, thereby enabling the scraper blade 57 to push ahead of it that material supported on the base 45. Since the forward lip portion 53 of the partition extends beyond the pusher structure 55, upward movement of the material on the base, due to compaction, is prevented, thereby assuring discharge of such material horizontally through the throat T toward the mold 17. As those cavities of the mold 17 closest to the discharge side of the hopper 21 are filled, material subsequently discharged from the hopper will pass over and fill the more remote mold cavities.

As the charging member 49 moves toward its second position, the bars 71 move longitudinally of the rails 63, thereby causing corresponding movement of the scraper members 67 and 73 to the positions indicated in FIG. 5.

Following movement of the charging member 49 through its full charging stroke, the ram 58 is extended, thereby rocking the charging member 49 rearwardly toward its initial position. The scrapers 67 and 73 also move rearwardly, the scraper 73 moving across the upper surface of the mold 17 and scraping any excess material from the mold toward the base 45, thereby avoiding overfilling of the mold. Material which is scraped off the mold is deposited on the strip 76 in readiness to be discharged to the mold on the next cycle of operation. The arcuate length of the partition 51 is such that, when the charging member 49 has been moved to its forwardmost position, the rear lip portion 54 occupies a position rearwardly of the hopper's rear wall 23, thereby preventing spillage of material from the hopper onto the base 45. Thus, when the charging member is in its forwardmost position, the contents of the hopper are supported solely by the partition 51.

As is indicated in FIG. 5, movement of the charging member 49 from its initial position to its forwardly extended position results in a quantity of material M being supported on the forward lip portion 53 of the partition. This is an advantageous characteristic of the invention in that, upon return movement of the charging member 49 to its initial position, that material on the lip portion 53 will be engaged by the supply of material in the hopper 21 and pushed off the lip 53 in the vicinity of the forward end of the base 45. Thus, a quantity of material will be present adjacent the forward end of the base 45 at the beginning of the next charging stroke of the charging member.

Since not all molds have the same capacity, it is preferred that the quantity of material discharged from the lip portion 53 of the partition 51 to the forward portion of the base 45 be adjustable. Such adjustment may be obtained in either or both of two ways. First, the front wall 24 of the hopper may be adjusted vertically so as to vary the height of the throat T between the lower edge 34 of the wall and the partition 51. Second, the front wall 24 of the hopper may be swung in either of two opposite directions about the axis of the spindles 31 so as to increase or decrease the cross sectional area of the hopper at the level of the lower edge 34 of the front wall 24. These adjustments make it possible to provide a relatively thick or a relatively thin layer of material on the lip portion 53 of the partition and to vary the fore and aft length of such layer of material.

Following filling of the mold 17 and the return of the charging member 49 to its initial position, the stripper frame 12 is lowered into the mold 17 as the latter is vibrated to compact the concrete. Following vibration, the stripper frame 12 and the pallet support lifter frame 16 are lowered, while the mold 17 is held stationary, so as to strip the molded blocks from the mold. As the pallet support 13 is lowered, the pallet 14 is deposited on a conveyor 80 and conveyed toward the front wall 2 of the enclosure 1.

When the pallet lifter frame 16 reaches its lowermost position, as shown in chain lines in FIG. 2, the pallet 14 and the blocks thereon will be approaching the opening 6 through the front wall 6. To enable the opening to be clear, the lifter frame 16 may include a bracket 81 to which the closure 8 is fixed, thereby enabling the closure to move upwardly and downwardly with the lifter frame 16 to effect closing and opening of the opening. Thus, the only time that the closure does not overlie the opening 6 is during the discharge of molded blocks from the enclosure, and during this time most of the machine parts are stationary.

This disclosure is representative of presently preferred embodiments of methods and apparatus according to the invention, but are intended to be illustrative rather than definitive of the latter. The invention is defined in the claims.

I claim:

1. In a concrete block making machine of the kind having an enclosure with side walls and a top wall comprising panels formed of sound insulating material; a mold enclosed, except at its top and bottom, supported within the enclosure for vibratory movement; a pallet supporting and block stripping assembly comprising: a pallet support supported for vertical movement within the enclosure for moving a pallet up into a position in engagement with the bottom of said mold, and a stripper head mounted for movement relative to the mold to cooperate with the pallet support in stripping a compressed block from the mold; a block discharge means mounted for movement to eject a pallet with a molded block thereon from below the mold, the block discharge means having a pallet conveying run extending from below the mold over to one side wall of the enclosure; a cementitious material feed member device, supported within the enclosure, mounted for movement from a charging position in which it receives material to a discharging position for charging material into the open upper end of the mold; a chute extending through said enclosure to supply material to said feed device; the said side wall confronting said conveying run having a block exit opening therein aligned with said conveying run; the improvement wherein a closure for said opening is disposed between the said confronting side wall and terminal end of the conveying run; and means links said closure with said assembly to be moved thereby, for moving said closure between positions in which it closes and opens said block exit opening.

2. A machine according to claim 1 wherein said closure is mounted for sliding movement along said confronting side wall from one position to another.

* * * * *